US008061512B2

(12) United States Patent
Thomas

(10) Patent No.: US 8,061,512 B2
(45) **Date of Patent: *Nov. 22, 2011**

(54) COIN HOLDING APPARATUS

(76) Inventor: Tony Thomas, Alto, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/823,212

(22) Filed: Jun. 25, 2010

(65) Prior Publication Data

US 2010/0258454 A1 Oct. 14, 2010

Related U.S. Application Data

(63) Continuation of application No. 12/177,211, filed on Jul. 22, 2008, now Pat. No. 7,784,607.

(51) Int. Cl.
*A45C 1/00* (2006.01)

(52) U.S. Cl. ..... 206/0.8; 53/254; 53/468; 206/0.83; 206/0.84; 206/463

(58) Field of Classification Search ..... 206/0.8, 206/0.81–0.84, 445, 461–463; 53/254, 467, 53/468, 473, 475
See application file for complete search history.

(56) References Cited

U.S. PATENT DOCUMENTS

| | | | | |
|---|---|---|---|---|
| 2,527,389 | A | 10/1950 | Becker | |
| 3,085,378 | A | 4/1963 | Howard | |
| 3,135,566 | A | 6/1964 | Frank | |
| 3,312,336 | A | 4/1967 | Fally | |
| 3,346,109 | A | 10/1967 | Duran | |
| 3,776,375 | A | 12/1973 | Rohdin | 206/459.5 |
| 3,999,563 | A | 12/1976 | Frias, Jr. | |
| 4,183,432 | A | 1/1980 | Lemaire | 206/0.82 |
| 4,240,544 | A | 12/1980 | Barnhart et al. | 206/0.82 |
| 4,290,523 | A | 9/1981 | Wallace | 206/0.82 |
| D262,749 | S | 1/1982 | Taivalvuo | |
| 4,378,068 | A | 3/1983 | Bell | 206/461 |
| 4,541,528 | A | 9/1985 | Holmes | 206/0.82 |
| 4,715,492 | A | 12/1987 | Holmes | |
| 4,878,579 | A | 11/1989 | Hager | 206/0.84 |
| 5,042,650 | A | 8/1991 | Mayer et al. | 206/0.84 |
| D380,500 | S | 7/1997 | Cusumano | |
| D443,126 | S | 5/2001 | Reviea et al. | |
| 6,851,551 | B2 | 2/2005 | Lemaire | 206/0.83 |
| 6,905,014 | B2 | 6/2005 | Eldin | 206/0.84 |
| D596,375 | S | 7/2009 | Thomas | |
| 7,784,607 | B1 | 8/2010 | Thomas | |
| 2002/0162756 | A1 | 11/2002 | Seligman et al. | 206/0.82 |

OTHER PUBLICATIONS

U.S. Appl. No. 12/177,211, filed Jul. 22, 2008 and titled Coin Holding Apparatus.

*Primary Examiner* — Luan K Bui
(74) *Attorney, Agent, or Firm* — Williamson Intellectual Property Law, LLC; Thomas R. Williamson, III

(57) ABSTRACT

A coin holding apparatus includes a first plate and a second plate. The first and second plates are transparent and each of the first and second plates has a first side and a second side. The first sides of each of the first and second plates has a semi-cylindrical indentation therein and forms a bulbous portion extending outwardly from a plane of associated ones of the second sides. The semi-cylindrical indentation in the first plate is alignable with the semi-cylindrical indentation in the second plate to form a cylinder. A plurality of couplers releasably couples the first sides of the first and second plates together to releasably secure coins within the cylinders. Coins are removably positionable in the cylinders to store and display the coins in collectible condition.

17 Claims, 8 Drawing Sheets

COIN HOLDING APPARATUS

CROSS-REFERENCE TO RELATED APPLICATIONS

This Continuation Non-provisional Patent Application claims priority to, and the benefit of, U.S. patent application Ser. No. 12/177,211, filed Jul. 22, 2008, issued as U.S. Pat. No. 7,784,607 on Aug. 31, 2010, entitled Coin Holding Apparatus, said application being incorporated by reference herein.

PARTIES TO A JOINT RESEARCH AGREEMENT

None

REFERENCE TO A SEQUENCE LISTING

None

FEDERALLY SPONSORED RESEARCH OR DEVELOPMENT

None

BACKGROUND OF THE INVENTION

Technical Field of the Invention

The present invention relates to coin holding devices and more particularly pertains to a new coin holding device for displaying and storing a plurality of like coins in such a manner that they remain in collectible condition.

SUMMARY OF THE INVENTION

The present invention meets the needs presented above by generally comprising a first plate and a second plate. The first and second plates are transparent and each of the first and second plates has a first side and a second side. The first sides of each of the first and second plates has a semi-cylindrical indentation therein and forms a bulbous portion extending outwardly from a plane of associated ones of the second sides. The semi-cylindrical indentation in the first plate is alignable with the semi-cylindrical indentation in the second plate to form a cylinder. A plurality of couplers releasably couples the first sides of the first and second plates together to releasably secure coins within the cylinders. Coins are removably positionable in the cylinders to store and display the coins in collectible condition.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
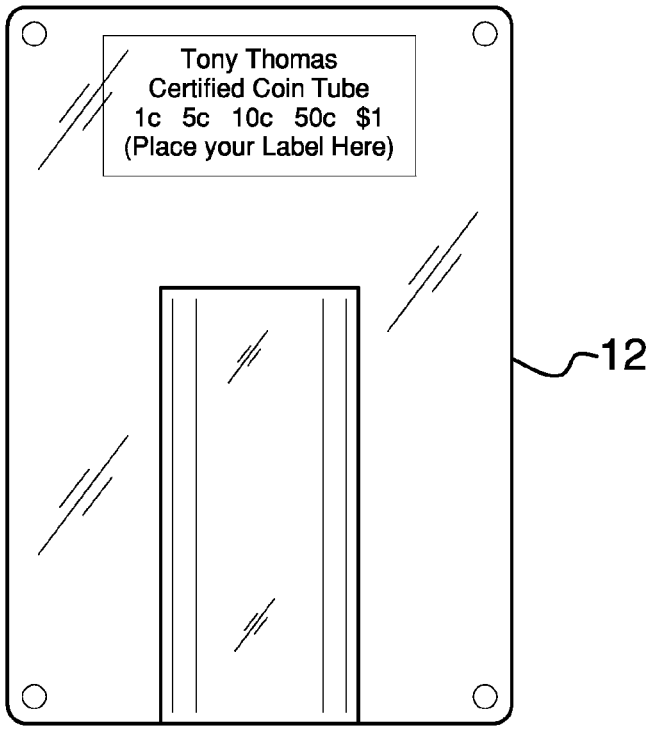
FIG. 1 is a front view of a coin holding apparatus according to the present invention.
Figure 2:
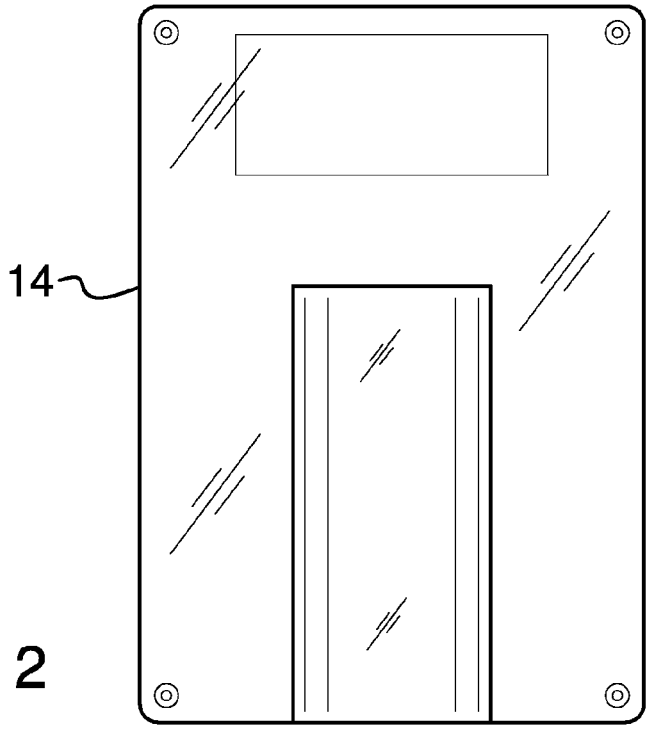
FIG. 2 is a rear view of the present invention.
Figure 3:
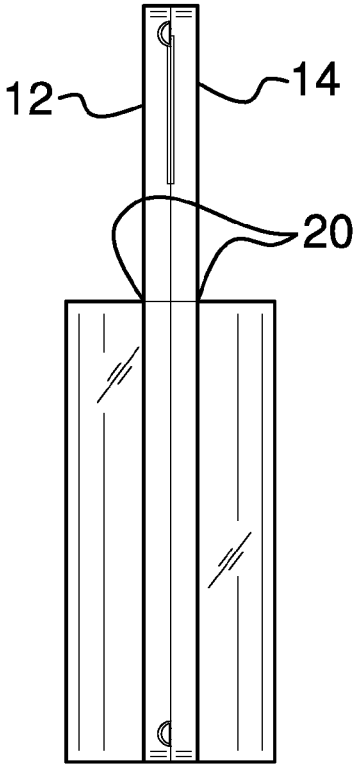
FIG. 3 is a side view of the present invention.
Figure 4:
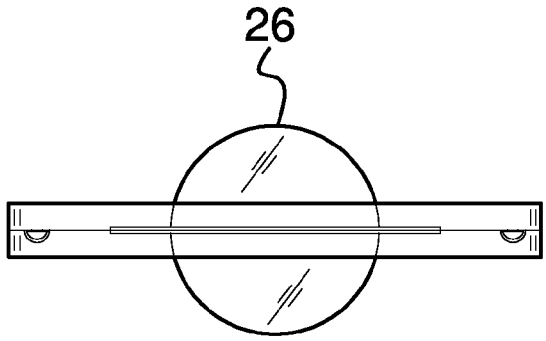
FIG. 4 is a top view of the present invention.
Figure 5:
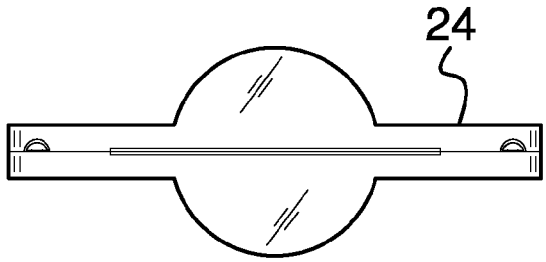
FIG. 5 is a bottom view of the present invention.
Figure 6:
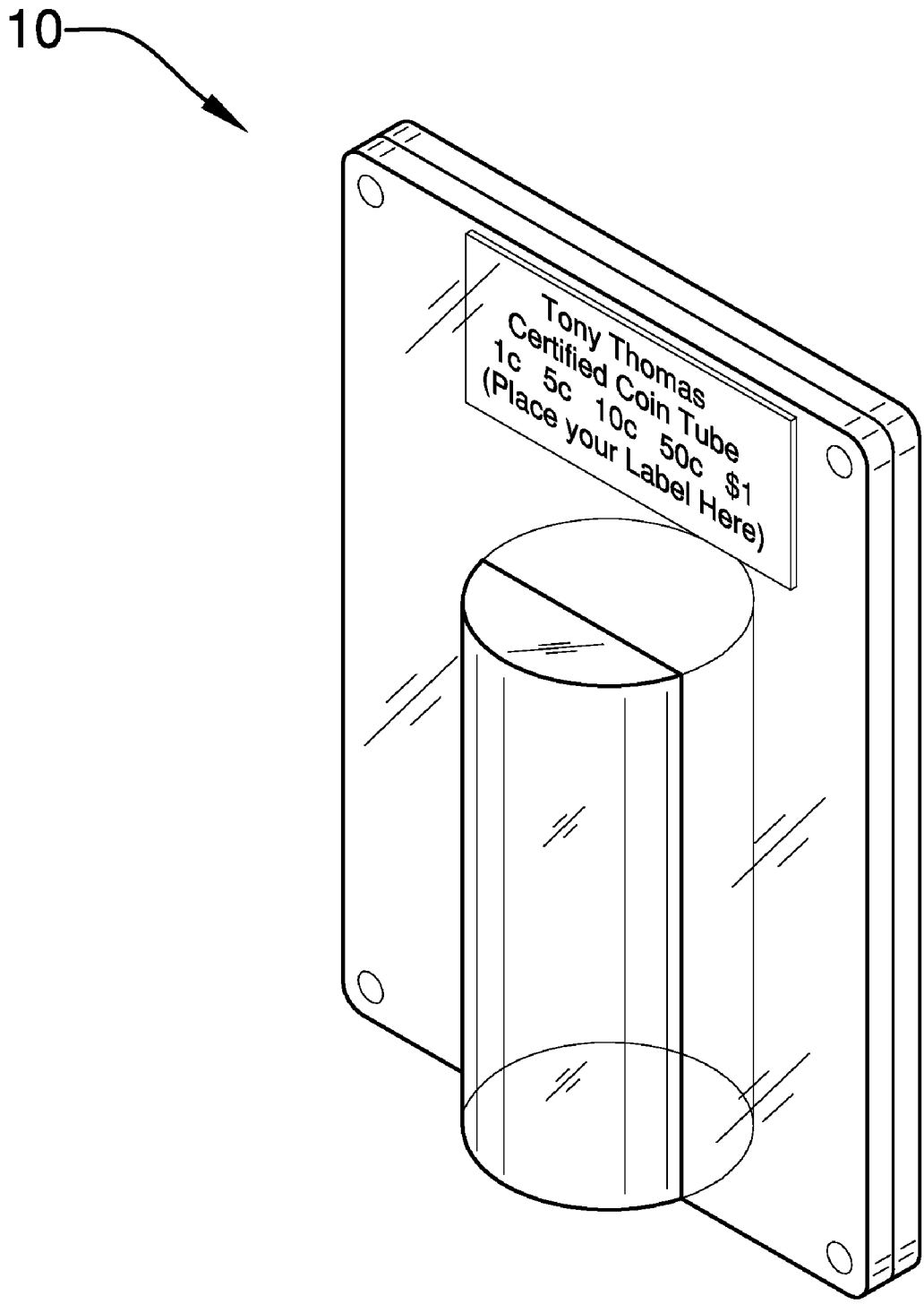
FIG. 6 is a front perspective view of the present invention.
Figure 7:
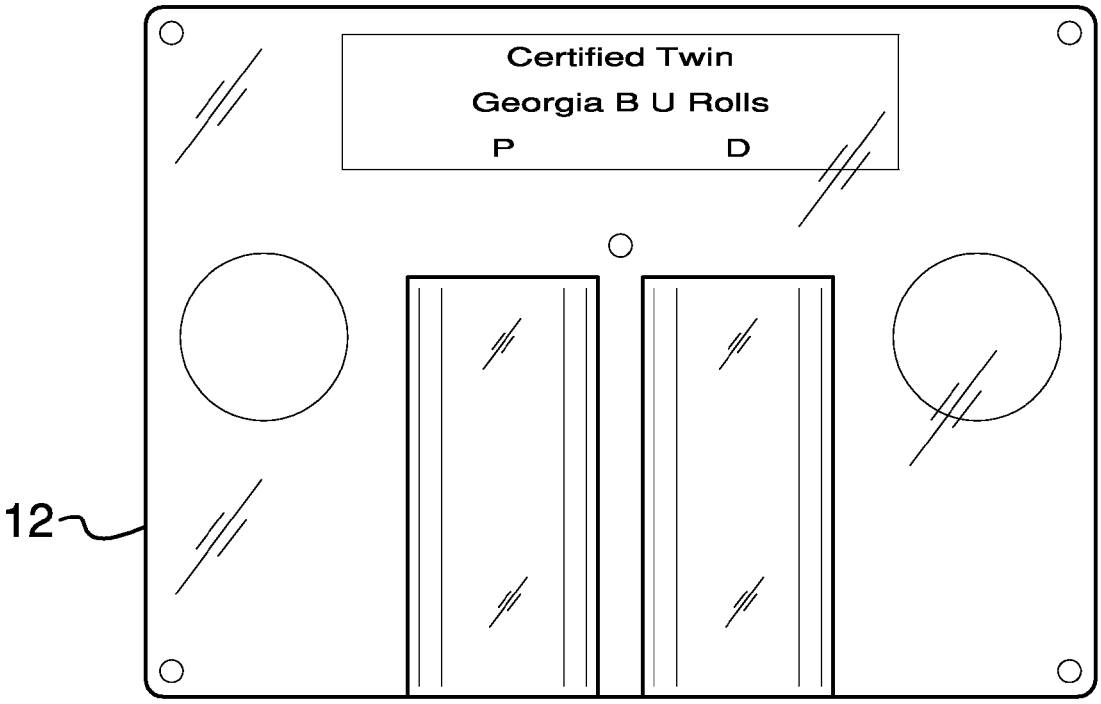
FIG. 7 is a front view of a second embodiment of the present invention.
Figure 8:
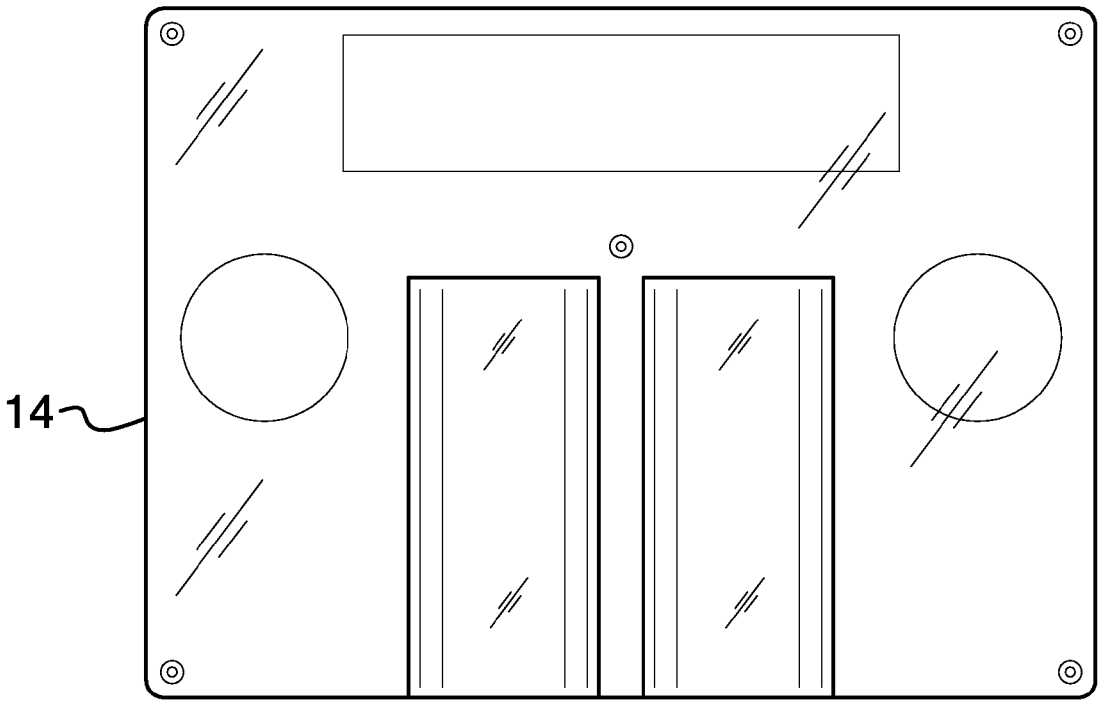
FIG. 8 is a rear view of the second embodiment of the present invention.
Figure 9:
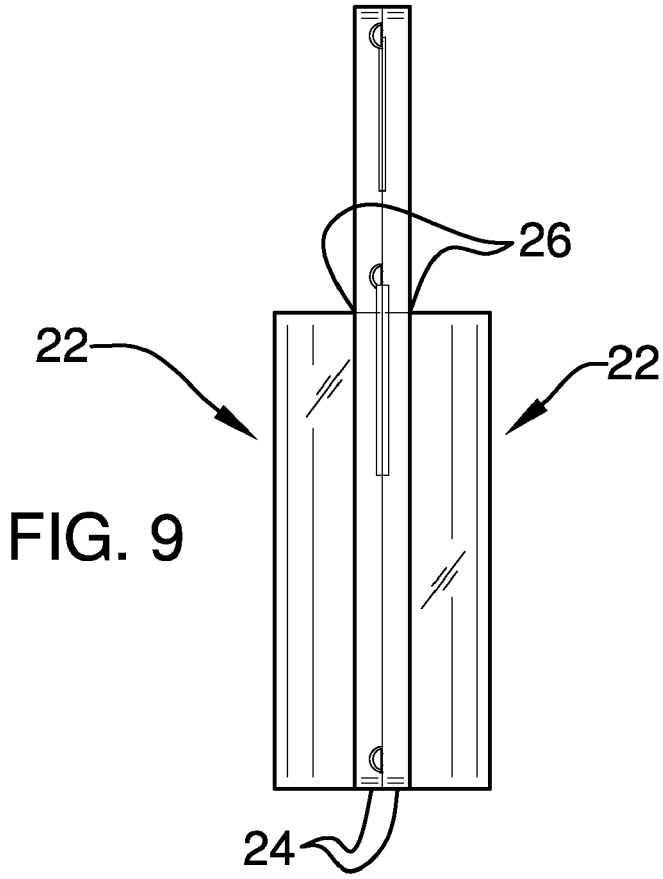
FIG. 9 is a side view of the second embodiment of the present invention.
Figure 10:
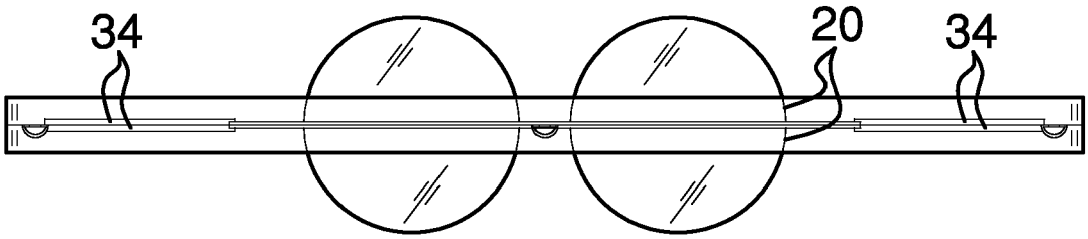
FIG. 10 is a top view of the second embodiment of the present invention.
Figure 11:
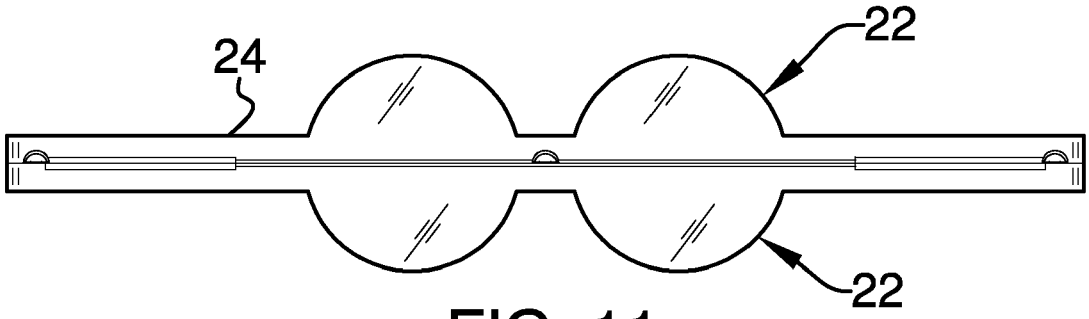
FIG. 11 is a bottom view of the second embodiment of the present invention.
Figure 12:
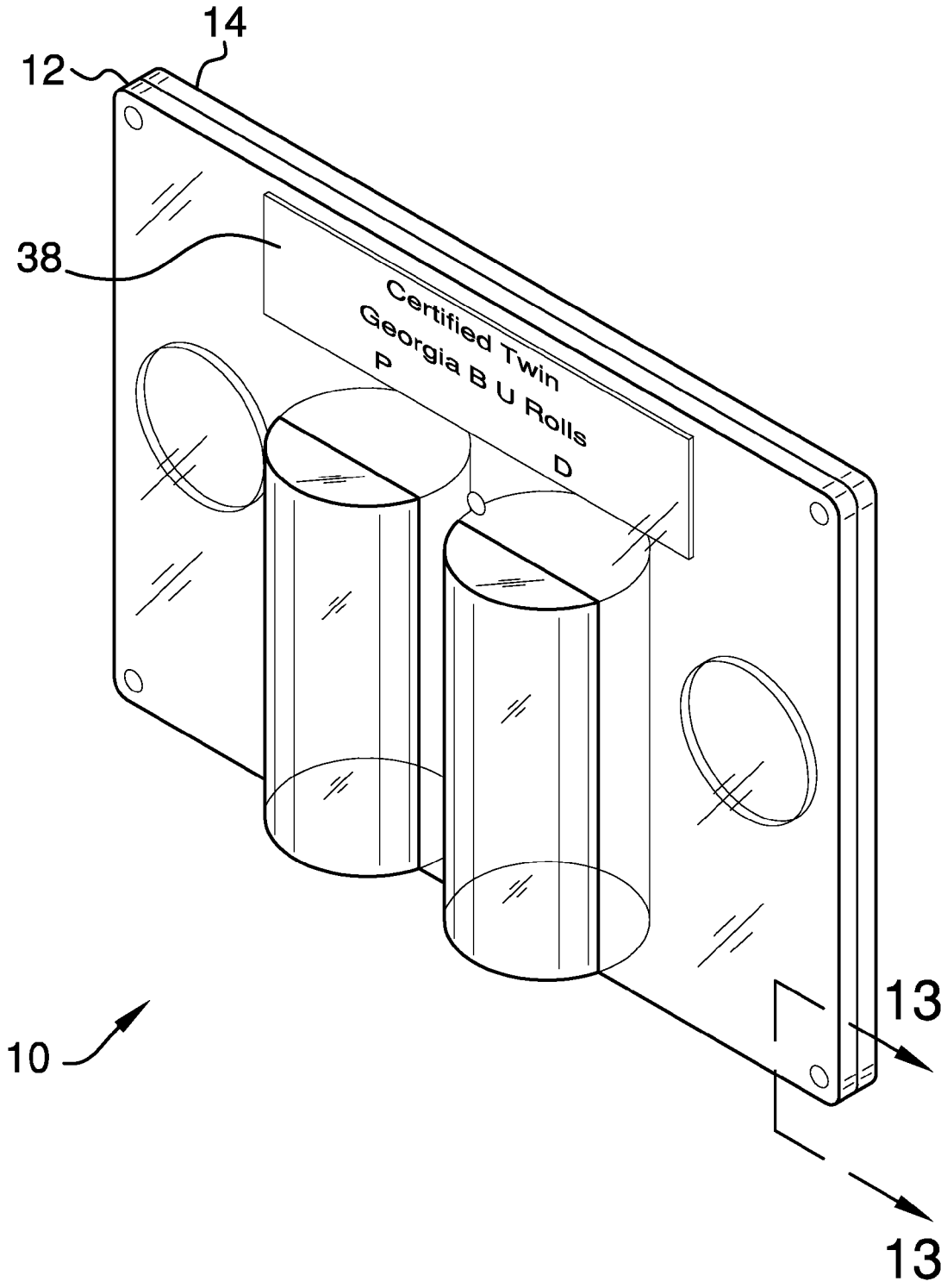
FIG. 12 is a front perspective view of the second embodiment of the present invention.
Figure 13:
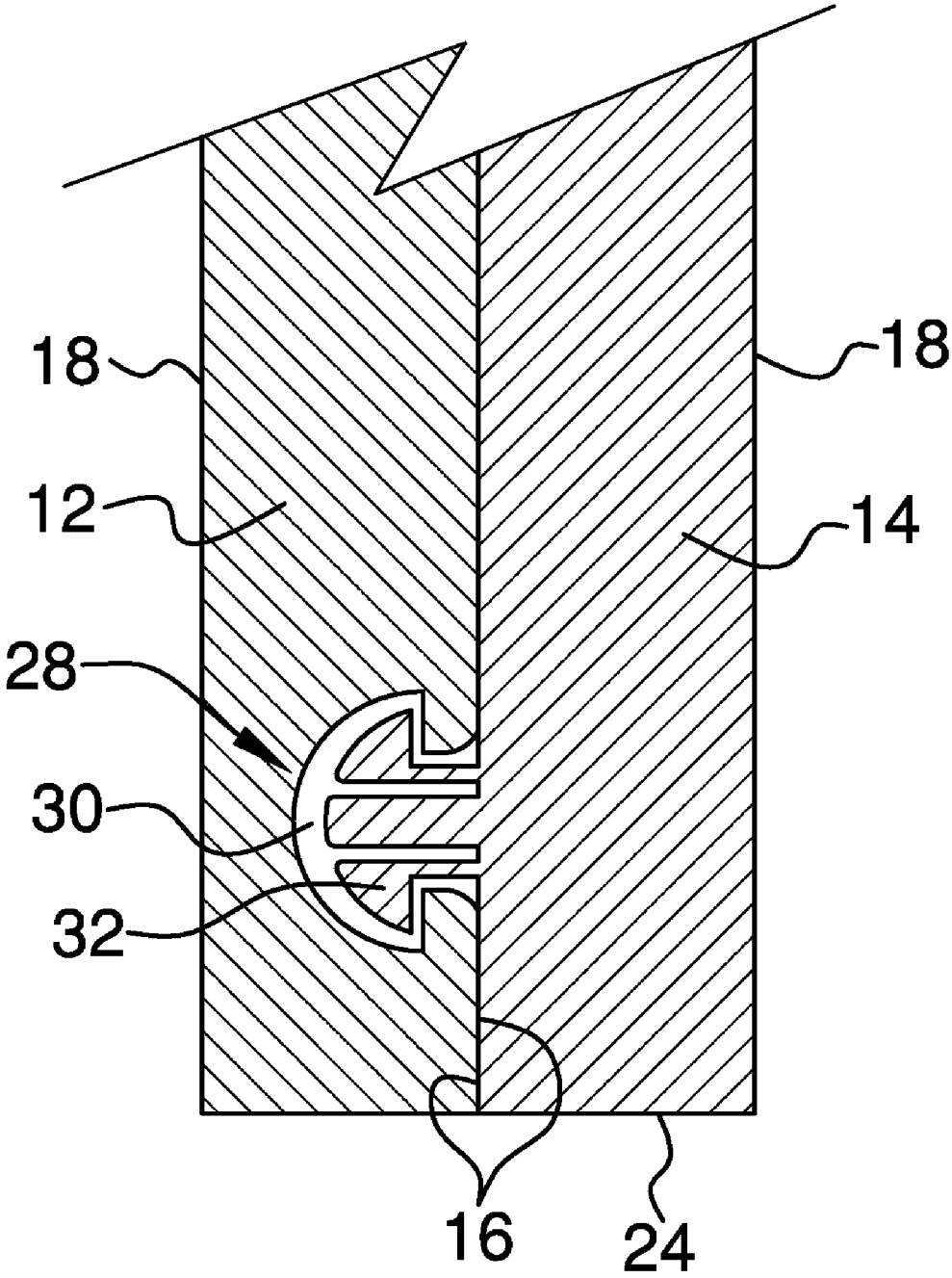
FIG. 13 is a cross-sectional view of the present invention taken along line 13-13 of FIG. 12.
Figure 14:
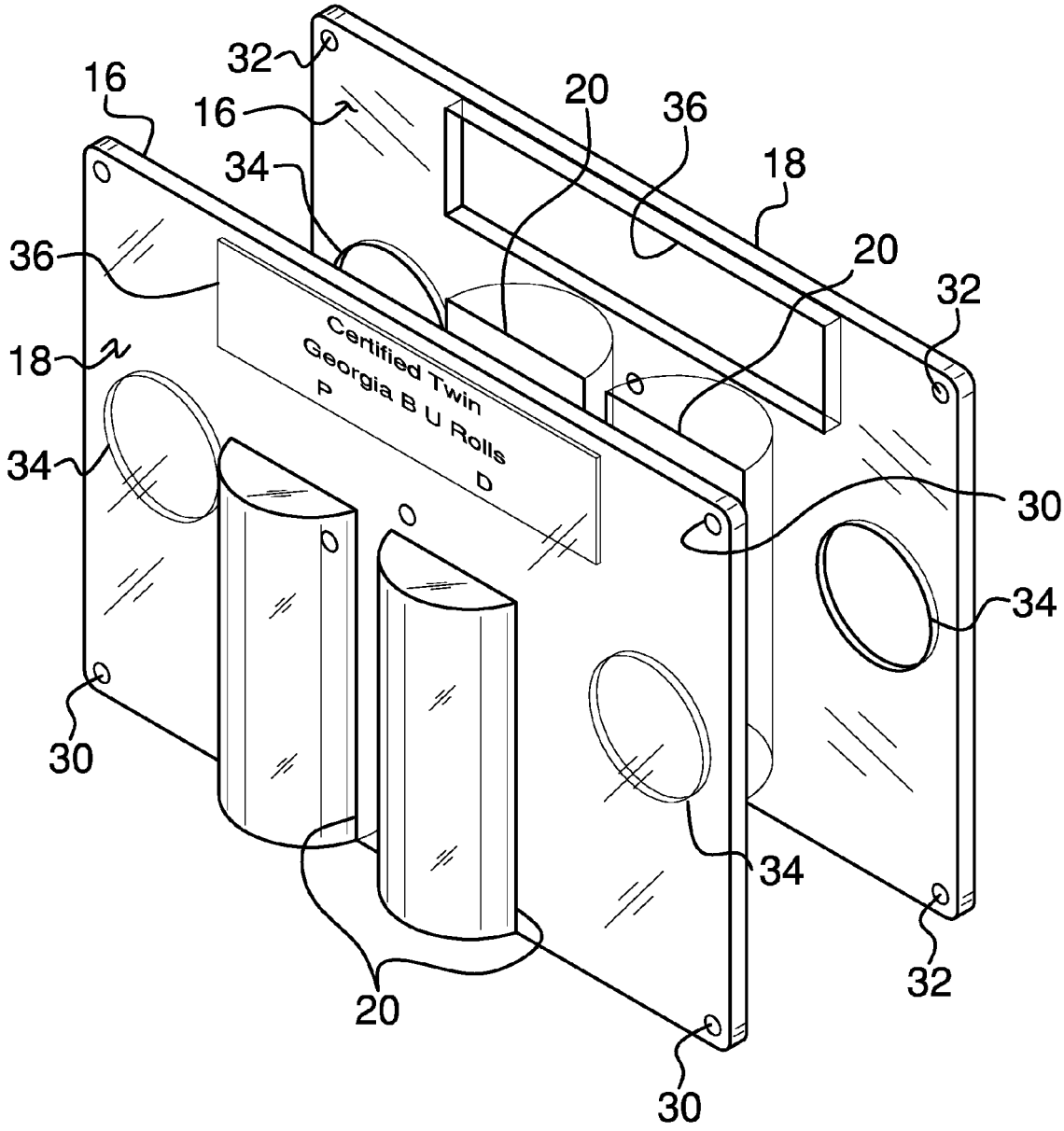
FIG. 14 is an expanded front perspective view of the second embodiment of the present invention.

With reference now to the drawings, and in particular to FIGS. 1 through 14 thereof, a new coin holding device embodying the principles and concepts of the present invention and generally designated by the reference numeral 10 will be described.

As best illustrated in FIGS. 1 through 14, the coin holding apparatus 10 generally comprises a first plate 12 and a second plate 14. The first 12 and second 14 plates are transparent and each of the first 12 and second plates 14 has a first side 16 and a second side 18. The first sides 16 of each of the first 12 and second 14 plates have a pair of semi-cylindrical indentations 20 therein and each forms bulbous portions 22 extending outwardly from a plane of associated ones of the second sides 16.

The semi-cylindrical indentations 20 in the first plate 12 are alignable with one of the semi-cylindrical indentations 20 in the second plate 14 to form a pair of cylinders. Each of the bulbous portions 22 abuts a bottom edge 24 of the first 12 and second 14 plates to define supports to retain the first 12 and second 14 plates in a vertical orientation. Each of the bulbous portions 22 has a planar upper end 26.

A plurality of couplers 28 releasably couples the first sides 16 of the first 12 and second 14 plates together to releasably secure coins within the cylinders formed by the semi-cylindrical indentations 20. The couplers 28 each comprise a plurality of female mating members 30 and male mating members 32. Each of the female mating members 30 extends into the first plate 12 and each of the male mating members 32 is attached to and extends away from the second plate 14. The male mating members 32 snappily engage the female mating members 30.

The first sides 16 of the first 12 and second 14 plates each have a pair of disc indentations 34 therein. Each of the disc indentations 34 in the first plate 12 is alignable with one of the disc indentations 34 in the second plate 14. The disc indentations 34 are spaced from the plane of an associated one of the second sides 18 so as to not form any bulging areas in the second sides 18. Each of the disc indentations 34 has a same diameter as the cylinders. Aligned ones of the disc indentations 34 have a depth to hold and display a single coin so that it may be viewed from each side of the apparatus 10.

The first sides of the first 12 and second 14 plates each have a panel indentation 36 therein. The panel indentation 36 in the first plate 12 is alignable with the panel indentation 36 in the second plate 14. The panel indentations 36 are spaced from the plane of an associated one of the second sides 18. The panel indentations 36 have a rectangular shape and releasably receive a panel 38 having indicia thereon describing coins stored in the cylinders.

In use, coins are removably positionable in the cylinders formed by the semi-cylindrical indentations 20 to store and display the coins in collectible condition. Further, the disc indentations 34 provide an area to display both sides of single coins while the panel indentations 36 hold display panels to help a person identify the coin being held within the cylinders.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A coin holding and displaying apparatus comprising:

a first plate and a second plate, said first and second plates being transparent, each of said first and second plates having a first side and an associated second side, said first sides of each of said first and second plates having a semi-cylindrical indentation therein, wherein said semi-cylindrical indentation forms a bulbous portion extending outwardly from a plane of said associated second sides, and wherein said bulbous portions abut a bottom edge of said first and second plates to define supports to retain said first and second plates in a vertical orientation, said semi-cylindrical indentation in said first plate being alignable with said semi-cylindrical indentation in said second plate to form a cylinder, and wherein each of said first and second plates further comprises a disc indentation therein, said disc indentation in said first plate being alignable with said disc indentation in said second plate, said disc indentations being spaced from the plane of an associated one of said second sides, wherein each of said disc indentations having a same diameter as said cylinder, and wherein said disc indentations have a depth to hold and display a single coin when said disc indentations are aligned and said first and second plates are coupled to each other; and a plurality of couplers releasably coupling said first sides of said first and second plates together to releasably secure coins within said cylinder, wherein the coins are removably positionable in said cylinder to store and display the coins in collectible condition.

2. The coin holding and displaying apparatus of claim 1, wherein said supports comprise said bulbous portions and said bottom edges of said first and second plates, and wherein portions of said first and second plates extend radially outward from said bulbous portions.

3. The coin holding and displaying apparatus of claim 2, wherein each of said bulbous portions has a planar upper end.

4. The coin holding and displaying apparatus of claim 1, wherein each of said plurality of couplers comprise a plurality of female mating members and male mating members, each of said female mating members extending into said first plate and each of said male mating members being attached to and extending away from said second plate.

5. The coin holding and displaying apparatus of claim 1, wherein said first sides of said first and second plates each having a panel indentation therein, said panel indentation in said first plate being alignable with said panel indentation in said second plate, said panel indentations being spaced from the plane of an associated one of said second sides, said panel indentations having a rectangular shape and releasably receive a panel having indicia thereon describing coins stored in said cylinder.

6. The coin holding and displaying apparatus of claim 2, wherein said first sides of said first and second plates each having a panel indentation therein, said panel indentation in said first plate being alignable with said panel indentation in said second plate, said panel indentations being spaced from the plane of an associated one of said second sides, said panel indentations having a rectangular shape and releasably receive a panel having indicia thereon describing coins stored in said cylinder.

7. The coin holding and displaying apparatus of claim 1, wherein said first and second plates are completely separable from each other to allow coins to be positionable in said indentation of one of said first and second plates, the coins thereafter being positioned within said cylinder when said first and second plates are placed in abutment with each other and said indentations are aligned with each other.

8. A method of storing and displaying at least one coin in a collectible condition, said method comprising the steps of:

removably positioning the at least one coin in a cylinder formed from a first plate and a second plate, said first and second plates being transparent, each of said first and second plates having a first side and an associated second side, said first sides of each of said first and second plates having both a semi-cylindrical indentation and a disc indentation therein, wherein said semi-cylindrical indentation forms a bulbous portion extending outwardly from a plane of said associated second sides, and wherein said bulbous portions abut a bottom edge of said first and second plates to define supports to retain said first and second plates in a vertical orientation, said semi-cylindrical indentation in said first plate being alignable with said semi-cylindrical indentation in said second plate to form said cylinder, and wherein said disc indentation in said first plate being alignable with said disc indentation in said second plate, said disc indentations being spaced from the plane of an associated one of said second sides, wherein each of said disc indentations having a same diameter as said cylinder, and wherein said disc indentations have a depth to hold and display a single coin when said disc indentations are aligned and said first and second plates are coupled to each other; and releasably coupling said first sides of said first and second plates together by engagement of a plurality of couplers to releasably secure the at least one coin within said cylinder.

9. The method of claim 8, further comprising the step of:

supporting the coin holding and displaying apparatus via said supports, wherein said supports comprise said bulbous portions and said bottom edges of said first and second plates, and wherein portions of said first and second plates extend radially outward from said bulbous portions.

10. The method of claim 9, further comprising the step of:

securing said first and second plates together via a plurality of female mating members and male mating members, each of said female mating members extending into said first plate and each of said male mating members being attached to and extending away from said second plate.

11. The method of claim 10, further comprising the step of:

releasably receiving a panel having indicia thereon describing coins stored in said cylinder, wherein the panel is disposed in panel indentation in said first and second plates, said panel indentation in said first plate being alignable with said panel indentation in said second plate, said panel indentations being spaced from the plane of an associated one of said second sides, said panel indentations having a generally rectangular shape.

12. A coin display comprising:

a first plate and a second plate, said first and second plates being transparent, each of said first and second plates having a first side and an associated second side, said first sides of each of said first and second plates having at least one disc indentation and at least one semi-cylindrical indentation therein, wherein said at least one semi-cylindrical indentation forms a bulbous portion extending outwardly from a plane of said associated second sides, wherein each of said bulbous portions abuts a bottom edge of its respective plate to define a supporting surface to retain said first and second plates in a vertical orientation, and wherein said at least one semi-cylindrical indentation in said first plate being alignable with a corresponding semi-cylindrical indentation from one of said at least one semi-cylindrical indentations in said second plate to form a cylinder, wherein said at least one disc indentation is associated with a respective cylinder, and wherein said at least one disc indentation in said first plate being alignable with said at least one disc indentation in said second plate, and wherein said disc indentations being spaced from the plane of an associated one of said second sides, and wherein each of said disc indentations having a same diameter as said associated respective cylinder, and wherein said disc indentations have a depth to hold and display a single coin when said disc indentations are aligned and said first and second plates are coupled to each other; and a plurality of couplers releasable coupling said first sides of said first and second plates together to releasably secure the at least one coin within said cylinder, wherein the at least one coin is removably positionable in said cylinder to store and display the at least one coin in collectible condition.

13. The coin display of claim 12, wherein said supporting surfaces comprise said bulbous portions and said bottom edges of said first and second plates.

14. The coin display of claim 13, wherein each of said at least one bulbous portions has a planar upper end.

15. The coin display of claim 12, wherein said couplers each comprise a plurality of female mating members and male mating members, each of said female mating members extending into said first plate and each of said male mating members being attached to and extending away from said second plate.

16. The coin display of claim 13, wherein said first sides of said first and second plates each having at least one panel indentation therein, said at least one panel indentation in said first plate being alignable with said at least one panel indentation in said second plate, wherein said at least one panel is associated with said associated respective cylinder, said panel indentations being spaced from the plane of an associated one of said second sides, said panel indentations having a rectangular shape to releasably receive a panel having indicia thereon describing the at least one coin stored in said associated respective cylinder.

17. The coin display of claim 12, wherein said first and second plates are completely separable from each other to allow the at least one coin to be positionable in said semi-cylindrical indentation of one of said first and second plates, the at least one coin thereafter being positioned within said cylinder when said first and second plates are placed in abutment with each other and said semi-cylindrical indentations are aligned with each other.

* * * * *